US007056845B2

(12) United States Patent
Waeber et al.

(10) Patent No.: US 7,056,845 B2
(45) Date of Patent: Jun. 6, 2006

(54) FINISHING OF TEXTILE FIBERS, TISSUES AND FABRICS

(75) Inventors: Peter Waeber, Flawil (CH); Alfred Klaus, Au (CH); Walter Marte, Ulisbach (CH); Ulrich Meyer, Zürich (CH)

(73) Assignee: Schoeller Textil AG, Sevelen (CH)

( * ) Notice: Subject to any disclaimer, the term of this patent is extended or adjusted under 35 U.S.C. 154(b) by 212 days.

(21) Appl. No.: 10/240,866

(22) PCT Filed: Apr. 2, 2001

(86) PCT No.: PCT/CH01/00221

§ 371 (c)(1),
(2), (4) Date: Oct. 4, 2002

(87) PCT Pub. No.: WO01/82805

PCT Pub. Date: Nov. 8, 2001

(65) Prior Publication Data

US 2003/0100234 A1 May 29, 2003

(30) Foreign Application Priority Data

| | | |
|---|---|---|
| Apr. 4, 2000 | (CH) | 660/00 |
| Jun. 16, 2000 | (CH) | 1218/00 |
| Mar. 26, 2001 | (CH) | 556/01 |

(51) Int. Cl.

| | |
|---|---|
| ***B32M 27/04*** | (2006.01) |
| ***B32M 27/12*** | (2006.01) |
| ***B32M 5/02*** | (2006.01) |
| ***D06M 15/643*** | (2006.01) |

(52) U.S. Cl. ..... 442/86; 442/87; 442/90; 442/91; 252/8.61; 252/8.62; 106/2

(58) Field of Classification Search ..... 252/8.62, 252/8.61; 442/86, 87, 90, 91; 106/2
See application file for complete search history.

(56) References Cited

U.S. PATENT DOCUMENTS

| | | | | |
|---|---|---|---|---|
| 3,632,419 | A * | 1/1972 | Horie et al. | 442/93 |
| 3,989,457 | A * | 11/1976 | Marte | 8/182 |
| 4,477,514 | A * | 10/1984 | Gee et al. | 442/95 |
| 4,610,915 | A | 9/1986 | Crenshaw et al. | |
| 6,074,753 | A | 6/2000 | Berndt | |
| 6,617,267 | B1 * | 9/2003 | Soane et al. | 442/79 |
| 6,660,363 | B1 | 12/2003 | Barthlott | |
| 2004/0019141 | A1 * | 1/2004 | Bastelberger et al. | 524/261 |

FOREIGN PATENT DOCUMENTS

| | | | |
|---|---|---|---|
| DE | 197 01 550 | | 7/1998 |
| GB | 763 464 | | 12/1956 |
| WO | PCT/EP95/02934 | | 7/1994 |
| WO | WO 97/00995 | * | 1/1997 |
| WO | WO 02/24828 A1 | * | 9/2001 |

OTHER PUBLICATIONS

H. G. Edelman et al., "Ultrastructure And Chemistry Of The Cell Wall Of The Moss Rhacocarpus Purpurascens: A Puzzling Architecture Among Plants," Planta, vol. 206:315-421, (1988).

W. Barthlott et al., "Nur Was Rauh Ist, Wird Von Selbst Sauber," Technische Rundschau No. 10, pp. 56-57, (1999).

H. K. Rouette, "Lexikon Für Textilveredlung", Laumann-Verlag, Dülmen XP002170546, Seite 1594-1595.

* cited by examiner

*Primary Examiner*—Norca L. Torres
(74) *Attorney, Agent, or Firm*—Barnes & Thornburg LLP

(57) ABSTRACT

A method is provided for the application of a finishing layer to a textile support material. A water repellent or oil repellent layer, a so-called finishing layer, is applied to a textile support material selected from the group of fibers, tissues, and fabrics. The water repellent or oil repellent finishing layer comprises at least two water repellent or oil repellent components wherein a first component comprises one or more dispersants and a second component comprises one or more dispersed phases or colloids, and wherein the dispersant and the dispersed phase are present in the gel state.

22 Claims, No Drawings

FINISHING OF TEXTILE FIBERS, TISSUES AND FABRICS

CROSS-REFERENCES TO RELATED APPLICATIONS

This application is a U.S. national application of international application serial No. PCT/CH01/00221, filed Apr. 2, 2001, which claims priority to Swiss patent applications serial No. 660/00, filed Apr. 4, 2000, 1218/00, filed Jun. 16, 2000 and 556/01, filed Mar. 26, 2001.

The present invention relates to water and oil repellent textile fibers and fabrics as well as to a method for the finishing of textile fibers, tissues, and fabrics, and particularly to the generation of washing and cleaning resistant, water and oil repellent finishing effects on textile fibers, tissues, and fabrics. These finishing effects are commonly referred to a water repellent and oil repellent finishing.

BACKGROUND OF THE INVENTION

Today, a plurality of water repellent finishing chemicals is used in textile processing which are classified into the wash-resistant and the not wash-resistant waterproofing agents on the one hand and into fluorocarbon-containing and not fluorocarbon-containing waterproofing agents on the other hand. Another group comprises the silicone-containing waterproofing agents. The use of silicone-containing waterproofing agents is also known in combination with fluorocarbon resins. Heavy metal-containing fatty acid derivatives, particularly paraffins with organometallic compounds, are employed alone and in combination with fluorocarbon resins in the finishing of textile fibers, tissues and fabrics.

Common to all waterproofing agents is their more or less apolar, water insoluble character due to which they are used in the form of emulsions or microemulsions, respectively.

Nowadays, waterproofing agents which are not wash-resistant are of less importance since also the quality of the water repellent finishing effects achieved by them does no longer comply with today's standards and requirements.

The most widely used products and the finishings produced by them, respectively, are based on reactive, lipid modified α-aminoalkylation products, fluorocarbon resins, and silicone derivatives or the mixtures thereof. According to present processing technique, best water repellent finishing effects can only be achieved using fluorocarbon resins or in combination with lipid modified, reactive, pre-polycondensed α-aminoalkylation products (extenders) and self-crosslinking binders (boosters).

Lipid modified, reactive group-containing compounds refers to all those compounds which contain at least one reactive group in addition to one or more covalently bound alkyl groups ($C_8$–$C_{25}$). Preferably used lipid modified α-aminoalkylation products are N-methylol compounds of fatty amines, fatty amides as well as formaldehyde-methylolated urea derivatives which may also contain partially etherified methylol functions.

Due to the growing environmental awareness of the consumers on the one hand and increasingly strict legal regulations on the other hand there is an increasing demand for textile finishings which meet even the latest ecological standards. This means that both the fiber materials used and the colorants and finishing agents must be environmentally friendly in the broadest sense. The consumer demands textiles which may be worn safely. This means in the case of clothing that they should be non-irritant and free from allergenic substances but at the same time fulfill the highest demands for wearing comfort and functionality.

During textile manufacturing it is necessary to ensure the handling safety of the starting materials and the finishing and auxiliary agents used. Also the safe disposal of the waste chemicals, waste waters, and outgoing air arising upon production and processing is called for. And eventually, in the sense of a closed system, the textiles should be disposed of or recycled with as low environmental pollution as possible.

Taken together, these demands have already today resulted in an outlawing of many dyestuffs, halogenated and silicone-containing chemicals as well as the silicones themselves, as used e.g. in the water repellent finishings of clothing and technical fabrics. In particular, halogenated finishing agents, if used, result in waste water components which are difficult to dispose of as well as in problems with the disposal of the technical textiles and clothing finished therewith themselves after their serviceable life has expired.

SUMMARY OF THE INVENTION

It is an object of the present invention to provide a novel method of textile finishing, particularly for water and oil repellent finishing of textiles (water repellency and oil repellency) which enables the preparation of textile fibers and fabrics that are equal on a high level or even superior with respect to their functional properties to products prepared according to known finishing methods and at the same time allow a complete or partial substitution of the standard chemicals employed today by novel compounds which have not been used to date.

It is another object of the present invention to provide water repellent and oil repellent finishings of textiles enabling a complete or at least partial regeneration of the water or oil repellent finishing effect which abates with time.

It is another object of the present invention to provide a method for textile finishing enabling the elimination of undesired, environmentally hazardous chemicals without having to lower one's sights with respect to quality and functionality of the finishing.

These objects have been achieved by a novel water repellent or oil repellent finishing layer according to the claims.

DETAILED DESCRIPTION OF THE INVENTION

An essential feature of the invention is the use of a dispersion system (wherein dispersions also comprises emulsions) as a "guest-host" system which enables a spatial self-organization of the finishing components. By this self-organization of the "guest" and the "host" components, i.e. the dispersed phase and the dispersant, an anisotropic distribution of the "guest" component or the dispersed phase within the "host" component is achieved within the finishing layer. In the final finishing layer, the "guest" component concentrates at the upper surface of the finishing layer and thereby dominates the physical, chemical, and physico-chemical properties at this phase boundary layer between the finishing layer applied and the surrounding atmosphere.

If gelling additives such as high molecular weight soluble polysaccharides or polar crosslinking components, e.g. glycerol and methoxy methylolated urea derivatives, are added to the water phase of the dispersion system, membrane formation on the tissue occurs in addition to the above-mentioned self-organization. In the course of this process, the initially homogenous dispersion system partitions depending on the drying conditions into two liquid phases referred to as coacervates. One of these predominantly contains the gelling polymer fractions while the other is dominated by the apolar, water or oil repellent components. Due to the crosslinking reaction that progresses during the drying process a contraction of the polymer gel occurs leading to the formation of the pore system of a membrane out of the originally gel-like structure.

The final finishing layer essentially corresponds to a dispersion in the gel state. The heterodisperse system may be utilized for the formation of columnar structures and thereby for the generation on the finished textile of a microrough surface exerting the so-called "lotus effect". This phenomenon is known from nature (Ultrastructure and chemistry of the cell wall of the moss *Rhadocarpus purpurascens*: a puzzling architecture among plants [1, 2]) and is transferred according to the present invention to textile water repellent or oil repellent finishings. The natural "lotus effect" is based on a three-dimensional surface structure wherein the wax crystals formed on leafs by self-organization account for a microroughness strongly promoting the self-cleaning effect of the plant [3].

Self-organization and formation of membrane structures, i.e. the tendency to undergo partial phase separation of the "guest" and the "host" components, results in an accumulation of the hydrophobic or oleophobic "guest" components at the surface, i.e. the phase separation layer between the finishing layer and the surrounding air. Thus, self-organization of the "guest" and "host" components results in dramatically enhanced water repellent or oil repellant finishing effects at the upper surface of the finishing layer as compared to a homogenously dispersed system.

In contrast to known methods the novel method of finishing permits the complete or partial elimination of environmentally hazardous chemicals. The chemicals to be used are selected in each case either due to the property profile required from the finishing or with respect to their physical, chemical, and physico-chemical suitability with regard to a) the formation of the desired three-dimensional surface structure (the columnar structure to achieve the "lotus" effect) and/or b) a inherent phase instability forming of the water repellent or oil repellent finishing liquor.

According to claim 1, for this purpose at least two different waterproofing chemicals as well as crosslinkable, gelatinizing chemicals (dispersant and dispersed phase) are applied to the fiber or tissue surface which due to their physical, chemical, and physico-chemical properties result in the desired microroughness and/or in an inherent phase instability of the water repellent finishing liquor during the subsequent drying and setting process.

Self-organization and membrane formation are determined by means of the phase instability as well as phase transitions of one or more of the finishing components.

Thus, essential features of the water repellent finishing system are different physical conditions of the water repellent components and/or thermodynamic instability of the mixed phase (oil in water emulsion) due to which one of the water repellent components increasingly orientates at the phase boundary layer (liquid/gas phase or solid/gas phase) similar to a tenside in the context of a self-organization process or for example leads to the formation of columnar structures. The dispersion is in the form of a sol during application and is transferred into the gel state as the procedure proceeds. During this process, one of the water repellent components, namely the "host" or dispersant, forms an amorphous matrix or membrane structure into which the secondary component, i.e. the "guest" or the dispersed phase, is embedded in correspondence with a "guest-host" system. The secondary or "guest" components may be roughly divided into two groups with respect to their functional properties. There are the "lotus" components on the one hand, and the "micellar" components on the other hand. Both groups of components show a certain mobility during drying until they are set which is of high importance for the self-organization and thus for the desired water repellent or oil repellent finishing effect.

The novel finishing layer permits an at least partially reversible transfer of the gel state of the dispersant and dispersed phase into the sol state by energy supply. This enables a complete or at least partial regeneration of the abating water repellency or oil repellency, particularly after the finishing layer has been worn down for an extended period. For this purpose it is not necessary to provide any external material. The capability of self-organization and the mobility of the colloids in the sol-like dispersion lead to a reorganization and concentration at the surface of the finishing layer, the interface to the surrounding medium. In the easiest of cases, the water repellent or oil repellent effect of a textile article having the novel finishing layer may be refreshed already by simple heating in the tumble dryer.

The "guest-host" system described may be extended by additional components depending on the property profile required from the finishing. Examples are the co-application of polymeric film formers to both enhance the adhesion on the textile material and the wash-resistance of the finishing. Of essential importance for self-organization or formation of colunmar structures, respectively, is the preparation of the water repellent or oil repellent finishing liquors. For this purpose, the major component with respect to its quantity (extender) of the water repellent or oil repellent finishing system is added into an aqueous emulsion into which the secondary component generally being even more apolar than the major component is emulsified. At the same time, a second solution is prepared containing the gelatinizing chemicals, i.e. the polymeric binder and optional catalysts. An oil in water emulsion is prepared using the two solutions by emulsifying the emulsion containing the waterproofing agents into the aqueous solution containing the gelling chemicals. Emulsifying of the water repellent or oil repellent finishing components is effected using e.g. rapidly rotating stirrer (rotor/stator principle) or high-pressure mixing systems. The water repellent or oil repellent finishing liquors prepared in this manner are applied to the textile material by conventional industrial application techniques such as padding, coating, spraying or foaming.

For improved adhesion of the water repellent or oil repellent finishing layer, particularly in the case of synthetic fiber materials, there may be applied adhesive layers which are also referred to as primer layers. The purpose of forming a primer layer on synthetic tissues is to provide directly or indirectly polymer attached reactive groups for covalent binding of the water repellent or oil repellent chemicals and the binder chemicals of the water repellent or oil repellent finishing layer. In the case of native fiber materials the function of the primer layers primarily is regulation of swelling or of the crush resistance which is often required in addition to water or oil repellency.

The formation of primer layers and the use thereof depend on the chemical nature of the support material. In the case of support materials made of synthetic or regenerated fibers, tissues or fabrics it has been found advantageous to form the primer layer either directly from a modified support material surface or to apply crosslinked natural or synthetic hydroxyl, carbonyl, amino, or thiol group containing polymers onto the support material. For example polyester materials provide the possibility to generate polymer bound hydroxyl and carbonyl groups via partial saponification of the polyester. During these partial saponifications upper layers of the polyester material are removed which correspond to a fraction of 0.01 to 1% of the polyester material, preferably 0.2 to 0.4%.

Reactive groups which are indirectly polymer bound may be formed for example by application of natural or synthetic hydroxyl group containing polymers such as lignin, polysaccharides, polyvinyl alcohol etc. and subsequent crosslinking with e.g. isocyanates or α-aminoalkylation products such as dimethylol ethylene urea or hexamethylol melamine derivatives.

The binders or gelatinizing agents used in combination with the waterproofing agents may be crosslinkable polycondensed formaldehyde resins (Luwipal 66 of BASF company) or the individual components thereof, prepolymeric acrylic or methacrylic acid derivatives, isocyanates, polyurethanes etc. in combination with multiple reactive group containing compounds such as polysaccharides, glycerol, or gelatin. Each of the binder or gelling systems is characterized by limited water miscibility, a property which they show inherently or after an appropriate thermal treatment.

As the major water repellent finishing components, also referred to as extenders, may be monomeric, prepolymeric or prepolycondensed but in any case lipid modified apolar acrylates, methacrylates, isocyanates or epoxide and urea derivatives which can be set in the textile material in a wash-resistant manner by thermal treatment and appropriate catalysts.

Due to its properties, the "guest" component or dispersed phase is mainly responsible for the self-organization of the water repellent or oil repellent finishing layer (phase separation) and for the formation of columnar structures having a directional orientation at the phase boundary layer, and may consist of widely different but always very apolar water or oil repellent auxiliary agents depending on the property profile of the finishing.

Specifically the agents may be silicone oils, lipid modified esters, ethers, or amides (such as glycerol ester and ether, sorbitan ester and ether) being high boiling point, apolar liquids which diffuse towards the phase boundary layer (solid/gas) during the setting process and are set in a position promoting the water repellent or oil repellent finishing effect.

Another group of agents includes fatty esters, alkyl ethers ($C_{12}$–$C_{25}$) and for example polycondensed fatty amides which are dispersed into the water repellent or oil repellent finishing emulsion in the form of solids and melt completely or only partially during the subsequent thermal setting and dominate the interface with their physical properties in accordance with the desired effect.

A third group comprises substances which form columnar structures. This group includes e.g. micronized waxes (particle sizes of 0.1–50 μm, preferably around 20 μm) such as polyolefin and fatty amide waxes as well as waxes being lipid modified aminoalkylation products, and hydrophobic silica particles (particle sizes of 5 to 100 nm), preferably nanoparticles having particle sizes of 5 to 50 nm which are also dispersed into the water repellent or oil repellent finishing liquor and are afterwards set in the finishing layer. Examples of such substances are Ceridust waxes (Clariant) or Aerosils (Degussa) which are preferably used.

The following Examples are illustrative of the efficiency of the method.

EXAMPLE 1

A primer layer is formed on a polyester tissue having a square meter weight of 180 g by partial saponification. (0.3%) for bonding the polyester to the water repellent layer. The tissue thus pretreated is impregnated with a water repellent finishing liquor using a liquor ratio of about 60%, then dried and condensed at 150° C. for 3 minutes. The water repellent finishing liquor contains the following components:

| | | |
|---|---|---|
| Water | 923.5 | ml/l |
| Citric acid | 5 | g/l |
| Aluminium sulfate | 0.5 | g/l |
| Perapret HVN (binder) | 26 | g/l |
| Guar gum (gelatinizing agent) | 2 | g/l |
| Phobotex FTC (extender) | 40 | g/l |
| Glycerol monooleate | 5 | g/l |

wherein Perapret HVN is a polymer dispersion based on polyacrylate and Phobotex FTC is a fatty acid-modified melamine-formaldehyde resin.

The water repellent tissue is characterized by very good test values which otherwise can only be achieved by fluorocarbon resins or silicone impregnations, respectively (see Table 1). Test criteria were the spray test according to ISO 4920-1981, the water repellency value according to Bundesmann (ISO 9865/1993) as well as the percentage of water absorption during the rain shower test determined gravimetrically.

TABLE 1

Water repellency test values

| | Initially | after 3 washings (according to EN 26330) |
|---|---|---|
| Spray test | 100% | 100% |
| Water absorption | 9% | 12% |
| Water repellency values | 1'/5, 5'/5, 10'/5 | 1'/5, 5'/4, 10'/4 |

EXAMPLE 2

A primer layer is formed on a polyester tissue having a square meter weight of 250 g by partial saponification (0.5%). The tissue thus pretreated is impregnated on a padding machine using a liquor ratio of 55%, and dried continuously on a tenter at 80° C. Setting of the water repellent finishing is performed at 160° C. for 3 minutes. Besides the other components the water repellent finishing liquor contains water repellent silica nanoparticles (Aerosil R812S) responsible for the columnar structures of the water repellent finishing layer.

| | | |
|---|---|---|
| Water | 757 | ml/l |
| Acetic acid | 5 | g/l |
| Aluminium sulfate | 0.5 | g/l |

-continued

| | | |
|---|---|---|
| Glycerol | 3 | g/l |
| Lyofix CHN | 9 | g/l |
| Cerol EWL | 220 | g/l |
| Tripalmitin | 4 | g/l |
| Aerosil R812S | 1.5 | g/l |

wherein Lyofix CHN is partially ethoxylated hexa-methylolmelamine resin, Cerol EWL is a fatty acid-modified melamine-formaldehyde resin, Tripahnitin is a mixture of di- and tri-palmitine esters of glycerol and Aerosil R812S is nano particles of methylated silicium dioxide.

In addition to very good water repellency results (Tab. 2) the treated tissue is characterized by a very soft "dry" handle; this is in contrast to silicone-based water repellent finishings which account for a slick handle. Another advantage is the improved slip resistance of the tissue. The test criteria are analogous to Example 1.

TABLE 2

| Water repellency test values | | |
|---|---|---|
| | Initially | after 3 washings |
| Spray test | 100% | 100% |
| Water absorption | 7% | 9% |
| Water repellency values | 1'/5, 5'/5, 10'/5 | 1'/5, 5'/5, 10'/5 |

EXAMPLE 3

Prior to water repellent finishing, a scoured and bleached cotton tissue having a square meter weight of 150 g is impregnated with a solution containing a crosslinker to minimize water penetration into the fibers as well as swelling of the fibers upon subsequent contamination with water. To prepare this primer layer the impregnating liquor contains 10 g/l Rucon FAN (Rudolf Chemie), 3 g/l citric acid, 5 g/l magnesium chloride, and 10 g/l Perapret HVN (BASF). Following impregnation with the primer liquor, the tissue is dried at 110° C. for two minutes. Subsequently, the water repellent finishing liquor is applied which contains all components for generating the water repellent finishing effect created by phase separation.

| | | |
|---|---|---|
| Water | 922.3 | ml/l |
| Guar gum | 2 | g/l |
| Citric acid | 3 | g/l |
| Aluminium sulfate | 1 | g/l |
| Phobotex FTC | 50 | g/l |
| Methacrylic acid dodecylester | 15 | g/l |
| Urea peroxide | 1.5 | g/l |
| Iron sulfate | 0.2 | g/l |
| Tris-(trimethylsilyl)-phosphate | 5 | g/l |

After impregnating the tissue on a padding machine (liquor ratio of 72%) drying is performed on a tenter at 100° C. Setting of the water repellent chemicals is done also on a tenter at 160° C. for two minutes. The water repellent finishing generated in this manner shows test values analogous to those found for Examples 1 and 2.

TABLE 3

| Water repellency test values | | |
|---|---|---|
| | Initially | after 3 washings |
| Spray test | 100% | 100% |
| Water repellency values | 1'/5, 5'/5, 10'/5 | 1'/5, 5'/5, 10'/5 |

EXAMPLE 4

A pretreated and dyed cotton/polyester tissue (70/30) having a square meter weight of 120 g is impregnated with a crosslinker solution for subsequent crosslinking of the cotton portion and dried and precondensed at 130° C. The crosslinker is a low-formaldehyde urea derivative (dimethoxy ethylene urea) using citric acid and magnesium chloride as catalysts.

In a second operation, oil repellent finishing of the tissue is carried out by applying to the tissue a liquor containing the following components and drying for one minute at 120° C. The liquor absorption is 65% based on the dry weight of the tissue.

| | | |
|---|---|---|
| Water | 953 | ml/l |
| Acetic acid 60% | 1 | ml/l |
| Ruco-Guard EPF 1561 | 40 | g/l |
| Ruco-Guard LAD | 4 | g/l |
| Aerosil R812S | 2 | g/l |

wherein Ruco-Guard EPF 1561 is an emulsion of polyisocyanate and Ruco-Guard LAD is an emulsion of aliphatic plyisocyanate.

Setting is performed on a tenter frame at a temperature of 160° C. for one minute.

The finished tissue shows very good water repellency and oil repellency as apparent from the test values presented in Table 4.

TABLE 4

| Table of oil repellency measuring values | | |
|---|---|---|
| | Initially | after 3 washings |
| Spray test | 100% | 100% |
| Water repellency values | 1'/5, 5'/5, 10'/5 | 1'/5, 5'/5, 10'/5 |
| Oil repellency* | 6 | 6 |

*according to AATCC Test Method 118–1997 (Oil repellency: Hydrocarbon Resistance Test)

EXAMPLE 5

A two-ply fabric having the following composition: 80% polyami, 10% PES Coolmax®, and 10% Lycra having a square meter weight of 170 g is coated with a foamed liquor for water repellent finishing the tissue primarily on one face. The coating liquor contains all chemicals required for achieving the water repellent finishing effect and for the formation of columnar structures.

| | | |
|---|---|---|
| Water | 914.5 | g/l |
| Citric acid | 5 | g/l |
| Aluminium sulfate | 0.5 | g/l |
| Phobotex FTC | 60 | g/l |
| Glycerol | 3 | g/l |
| Lyofix CHN | 10 | g/l |
| Tripalmitin | 4 | g/l |
| Ceridust 9615A | 3 | g/l |

The water repellent finishing liquor is dosed into the coating device of the tenter frame via a foam forming aggregate and is thus applied onto one face of the tissue. Drying is performed at a cooling temperature limit of about 50° C. on the above-mentioned tenter on which also the subsequent condensation/setting is carried out. This is performed at 160° C. for two minutes.

The effects achieved with this finishing (Tab. 5) demonstrate a very good water repellent effect with simultaneous good moisture transport which is very important for sportswear.

TABLE 5

Test values of the finishing

| | Initially | after 3 washings |
|---|---|---|
| Spray test | 100% | 100% |
| Water repellency values | 1'/5, 5'/5, 10'/5 | 1'/4, 5'/4, 10'/4 |
| Water absorption | 7% | 13% |

EXAMPLE 6

A polyamide tissue having a square meter weight of 150 g is impregnated with a liquor the ingredients of which form columnar structures due to the self-organization of the components occurring during setting. Wollpol A 702 (acidic crosslinking acrylic polymer, Reinhold company), and acrylic stearate are components of the binder system for improved setting of Phobotex FTC which is emulsified within the liquor in the form of a microdispersion. Using a padding machine the water repellent finishing liquor is applied to the tissue which is afterwards dried and condensed on a tenter. The water repellent finishing liquor consists of the following components:

| | | |
|---|---|---|
| Water | 825.5 | ml/l |
| Isopropanol | 50 | ml/l |
| Meypro guar gum Casaa M-200 | 2 | g/l |
| Magnesium chloride × 6 $H_2O$ | 4 | g/l |
| Wollpol A 702 50% | 30 | g/l |
| Acrylic stearate | 10 | g/l |
| Phobotex FTC | 75 | g/l |
| Azoisobutyronitrile | 0.5 | g/l |

The drying temperature is 60° C. and the condensation conditions are 150° C. and a treatment period of 2.5 minutes.

The water repellent finishing prepared in this manner is characterized by very good effects as demonstrated in Table 6. The thus waterproofed tissue is excellently suitable for the use in sportswear articles.

TABLE 6

| | Initially | after 3 washings |
|---|---|---|
| Spray test | 100% | 100% |
| Water repellency values | 1'/5, 5'/5, 10'/5 | 1'/5, 5'/5, 10'/5 |
| Water absorption | 3% | 8% |

With respect to two further Examples a "host" system on the basis of acrylate will be described in the following. Substitution of the above described stearyl modified melamine formaldehyde resins by stearyl modified polyacrylate has been found advantageous i.a. for the stability of the emulsion.

Various modified acrylic and methacrylic acid monomers (for example: acrylic acid dodecyl ester, methacrylic acid dodecyl ester, acrylic acid and methacrylic acid esters with terminal tertiary butyl group, acrylic acid and methacrylic acid esters with trimethylsilane group) were examined resulting in a statically modified, meltable, crosslinkable prepolymer upon emulsion polymerization.

EXAMPLE 7

A polyester tissue having a square meter weight of 230 g is impregnated with a water repellent finishing liquor the "host" component of which consists of stearyl modified, crosslinkable acrylic polymer. The preparation of the acrylic polymer is carried out according to an emulsion polymerization process. The acrylic polymer is used in the form of a 20–40% stock emulsion. For improved stabilization of the "guest-host" system, the triglyceride ("guest") which migrates on the tissue to the layer surface during setting is admixed already in the preparation of the acrylate emulsion. The stock emulsion containing the acrylic polymer and the triglyceride is then introduced into a water precharge according to the following protocol. The stearyl modified acrylic polymer is characterized by very good film formation which occurs during drying in a temperature range of 60–90° C.

| | | |
|---|---|---|
| Water | 733 | g/l |
| Isopropanol | 80 | g/l |
| Sorbitan monolaurate (Span 20) | 2.5 | g/l |
| Acrylate stock emulsion 32% | 180 | g/l |
| Aerosil R 812 S | 4.5 | g/l |

The water repellent finishing liquor is applied by impregnation of the tissue. The liquor weight is 48% based on the dry weight of the tissue. The drying conditions are 100° C. for 1.5 minutes followed by condensation at 150° C. for 2 minutes.

With respect to the water repellency criteria, the water repellent finishing prepared on acrylate basis may be directly compared to Phobotex finishings but has the further advantages of substantially higher liquor stability and a virtually formaldehyde-free finishing.

| | Initially | after 3 washings |
|---|---|---|
| Spray test | 100% | 100% |
| Water absorption | 6% | 8% |
| Water repellency values | 1'/5, 5'/5, 10'/5 | 1'/5, 5'/4, 10'/4 |

EXAMPLE 8

A polyester tissue designed for use in the sportswear article sector is provided with a water repellent finishing in accordance to the "guest-host" principle already mentioned several times above. The "host" system is formed by an acrylic prepolymer prepared from a monomer mixture consisting of methacrylic acid, methacrylic dodecyl ester and tertiary butyl amino ethyl methacrylate (SERPOL QMO 204) according to the emulsion polymerization procedure. To prepare the acrylate stock emulsion, 10% of a stearyl triglyceride based on the monomer weight is admixed into the monomer mixture. The solids content of the acrylate stock emulsion is 35%. The acrylic prepolymer containing the triglyceride has an excellent melting behaviour at 50–90° C. in combination with the desired film formation and the autodynamic orientation of the triglyceride an the layer surface. To prepare the water repellent finishing liquor, the acrylate stock emulsion is stirred into a water precharge together with the other partially predispersed chemicals (e.g. Aerosil R 812 S).

| | | |
|---|---|---|
| Water | 794 | g/l |
| Isopropanol | 50 | g/l |
| Acrylate stock emulsion 35% | 150 | g/l |
| Aerosil R 812 S | 5 | g/l |
| Polyvinylpyrrolidone K 90 | 1 | g/l |

Application is performed by impregnation of the tissue using a liquor ratio of 55% followed by drying at 110° C. for 1.5 minutes. Subsequent condensation leads to self-crosslinking of the acrylic polymer resulting in a very high washing resistance.

Tissues finished according to this protocol show very good water repellency properties together with high washing resistance which otherwise can only be achieved using fluorinated waterproofing agents.

| | Initially | after 3 washings |
|---|---|---|
| Spray test | 100% | 100% |
| Water absorption | 5% | 7% |
| Water repellency values | 1'/5, 5'/5, 10'/5 | 1'/5, 5'/5, 10'/5 |

REFERENCES

[1] H. G. Edelmann, C. Neinhuis, M. Jarvis, B. Evans, E. Fischer, W. Barthlott "Ultrastructure and chemistry of the cell wall of the moss *Rhacocarpus purpurascens*: a puzzling architecture among plants", Planta (1998) 206, 315–321

[2] PCT/EP95/02934, Priority date: P 44 26 962.5 of Jul. 29, 1994 Appicant: W. Barthlott, Title: "Self- cleaning surfaces of objects and process for producing same"

[3] W. Barthlott, C. Neinhuis, "Nur was rauh ist, wird von selbst sauber"Technische Rundschau No. 10 (1999), 56–57

The invention claimed is:

1. A water repellent or oil repellent finishing layer applied on a support material, the layer comprising at least two components wherein a first component comprises one or more dispersants comprising at least one polar component and a second component comprises one or more apolar dispersed phases, wherein the one or more apolar dispersed phases comprises at least one colloid, and wherein the one or more dispersants and the one or more apolar dispersed phases are present in a gel state, and wherein the at least one colloid of the one or more dispersed phases is distributed in the one or more dispersants in an anisotropic manner such that the at least one colloid is concentrated in an area of an upper surface of the finishing layer.

2. The water repellent or oil repellent finishing layer according to claim 1 wherein the upper surface of the finishing layer has the same or an enhanced water repellency or oil repellency as compared to the dispersant.

3. The finishing layer according to claim 1 wherein the dispersed phase comprises hydrophobic or oleophobic colloids which are concentrated at the upper surface of the finishing layer in a spatial orientation that promotes the water repellent finishing effect.

4. The finishing layer according to claim 3, wherein said dispersed phase comprises one or more apolar, water repellent compounds or a combination of apolar, water repellent compounds selected from the group consisting of the following: a) liquids and b) solids, whereby the liquids are selected from the group consisting of a1) silicone oils, a2) lipid modified esters and a3) high boiling point, apolar esters, and, the solids are selected from the group consisting of b1) fatty acid esters, b2) $C_{12}$ to $C_{25}$ alkyl ethers and b3) polycondensed fatty acid amides.

5. The finishing layer according to claim 4 wherein the high boiling point, apolar liquids of the dispersed phase comprise glycerol esters or ethers or sorbitan esters or ethers.

6. The finishing layer according to claim 1 wherein the dispersed phase comprises solid particles forming columnar structures with directional orientation at the upper surface of the finishing layer so that the microroughness of the surface generates a "lotus" effect.

7. The finishing layer according to claim 6 wherein the dispersed phase comprises one or more compounds or a combination of compounds selected from the following group consisting of:

micronized waxes having particle sizes between 0.1 and 50 μm;

waxes being lipid modified aminoalkylation or polyamide products; and hydrophobic silica nanoparticles with particle sizes between 5–50 nm.

8. The finishing layer according to claim 7 wherein said dispersed phase comprises micronized waxes selected from the group consisting of polyolefin and fatty amide waxes, and water repellent silica.

9. The finishing layer according to claim 1 wherein the dispersant comprises one or more waterproofing agent(s) or a combination thereof.

10. The finishing layer according to claim 9 wherein the waterproofing agent is selected from the group consisting of lipid modified, apolar acrylates, methacrylates, isocyanates, epoxy derivatives, and urea derivatives.

11. The finishing layer according to claim 10 wherein said waterproofing agents are monomeric, prepolymeric or prepolycondensed.

12. The finishing layer according to claim 1 wherein said dispersant comprises a polymeric binder.

13. The finishing layer according to claim 12, wherein said binder is selected from a group of the following: a) cross-linked, prepolycondensed formaldehyde resins or individual components of the prepolycondensed formaldehyde resions; and b) prepolymeric compounds or individual components of the prepolymeric compounds selected from the group consisting of b1) acrylic acid derivatives, b2) methacrylic acid derivatives, b3)isocyanates, and b4) polyurethanes.

14. The finishing layer according to claim 13 wherein the prepolymers are selected from the group consisting of modified acrylic acid and methacrylic acid monomers.

15. The finishing layer according to claim l4, wherein the prepolymers comprise compounds selected from the group consisting of the following: a) acrylic acid dodecyl esters; b) methacrylic acid dodecyl esters; c) acrylic acid and methacrylic acid esters having a terminal tertiary butyl group; and d) acrylic acid and methacrylic acid esters with trimethylsilane group the methacrylic acid esters with trimethysilane group being convertible into statically modified, meltable, crosslinkable prepolymers by emulsion polymerization.

16. The finishing layer according to any of claim 13 wherein the binder comprises a multiple reactive group containing compounds.

17. The finishing layer according to claim 16 wherein the multiple reactive group-containing compounds are selected from the group consisting of polysaccharides, glycerol, gelatin and mixtures thereof.

18. The finishing layer according to claim 1 wherein the gel state of dispersant and dispersed phase may be transferred in at least partially reversible manner into a sol state by energy supply.

19. A textile article comprising a textile fibers or fabrics, and a water repellent or oil repellent finishing layer applied onto a support material wherein the finishing layer comprises at least two components wherein a first component comprises one or more dispersant(s) and a second component comprises one or more dispersed phase(s), wherein the dispersed phase comprises at least one colloid, and wherein dispersant and dispersed phase are present in a gel state, and wherein the colloids of the dispersed phase are distributed in the dispersant in an anisotropic manner such that the colloids are concentrated in the area of the upper surface of the finishing layer.

20. The textile article according to claim 19 further comprising a primer layer between the support material and the water repellent or oil repellent finishing layer wherein said primer layer increases adhesion and bonding of the water repellent or oil repellent finishing layer.

21. The textile article according to claim 20 wherein said textile material comprises native materials and said primer layer comprises components which are deswelling and crosslinking with respect to the textile material.

22. The textile article according to claim 20 wherein said support material comprises synthetic and regenerated fibers, tissues, or fabrics, and that said primer layer is formed by a modified support material surface or by crosslinked natural or synthetic hydroxyl, carbonyl, amino, or thiol group containing polymers.

* * * * *

UNITED STATES PATENT AND TRADEMARK OFFICE

CERTIFICATE OF CORRECTION

PATENT NO. : 7,056,845 B2
APPLICATION NO. : 10/240866
DATED : June 6, 2006
INVENTOR(S) : Peter Waeber et al.

It is certified that error appears in the above-identified patent and that said Letters Patent is hereby corrected as shown below:

On The Title Page, Item -86- should read --PCT No.: PCT/CH01/00211--;

On The Title Page, Item -87- should read --PCT Pub. No.: WO01/75216--.

In column 7, line 12, “Tripahnitin” should read --Tripalmitin--.

In column 8, line 39, “plyisocyanate” should read --polyisocyanate--.

Signed and Sealed this

Twenty-ninth Day of May, 2007

JON W. DUDAS
*Director of the United States Patent and Trademark Office*